US007002518B2

(12) United States Patent
Lin et al.

(10) Patent No.: US 7,002,518 B2
(45) Date of Patent: Feb. 21, 2006

(54) LOW PROFILE SECTOR ANTENNA CONFIGURATION

(75) Inventors: Xintian E. Lin, Palo Alto, CA (US); Qinghua Li, Sunnyvale, CA (US); Alan E. Waltho, San Jose, CA (US); Allen W. Bettner, Los Gatos, CA (US)

(73) Assignee: Intel Corporation, Santa Clara, CA (US)

( * ) Notice: Subject to any disclaimer, the term of this patent is extended or adjusted under 35 U.S.C. 154(b) by 51 days.

(21) Appl. No.: 10/663,097

(22) Filed: Sep. 15, 2003

(65) Prior Publication Data

US 2005/0057420 A1 Mar. 17, 2005

(51) Int. Cl.
*H01Q 1/38* (2006.01)

(52) U.S. Cl. ..... 343/700 MS; 343/702

(58) Field of Classification Search ..... 343/700 MS, 343/702, 852, 853, 795, 797, 725, 776, 770, 343/792.5, 872
See application file for complete search history.

(56) References Cited

U.S. PATENT DOCUMENTS

| | | | | |
|---|---|---|---|---|
| 6,262,495 | B1 | 7/2001 | Yablonovitch et al. | 307/101 |
| 6,366,254 | B1 * | 4/2002 | Sievenpiper et al. | 343/770 |
| 6,493,155 | B1 * | 12/2002 | Lee et al. | 359/742 |
| 6,496,155 | B1 * | 12/2002 | Sievenpiper et al. | 343/770 |
| 6,670,932 | B1 * | 12/2003 | Diaz et al. | 343/909 |
| 6,853,336 | B1 * | 2/2005 | Asano et al. | 343/702 |
| 2003/0071763 | A1 | 4/2003 | McKinzie, III et al. | |
| 2003/0160730 | A1 | 8/2003 | Alsliety | |

OTHER PUBLICATIONS

D. Sievenpiper et al., "Low Profile, four-sector diversity antenna on high-impedance ground plane", Electronic Letters; Aug. 3rd, 2000, vol. 36 No. 16, pp. 1343-1345.

S. Rogers et al, "An AMC-Based 802.11a/b Antenna for Laptop Computers", Etenna Propritary Information: Submitted on Jan. 15, 2003 to the 2003 IEEE Antennas and Propagation Symposium in Columbus, OH, p. 1-4.

S. Rogers et al., "AMC Edge Treatments Enable High Isolation Between 802.11b and Bluetooth(TM) Antennas on Laptop Computers", Etenna Propritary Information: Submitted on Jan. 15, 2003 to the 2003 IEEE Antennas and Propagation Symposium in Columbus, OH., p. 1-4.

W. McKinzie et al., "A Multi-Band Artificial Magnetic Conductor Comprised of Multiple FSS Layers", Pressented at the 2003 IEEE Antennas and Propagation Symposium in Columbus, OH., Jun. 21-27, 2003. p. 1-4.

W. McKinzie et al., "A Low Profile Polarization Diversity Antenna Built on an Artificial Magnetic Conductor", Pressented at the 2002 IEEE AP-S Intl., Symp. San Antonio, TX, Jun. 16-21, p. 1-4.

(Continued)

*Primary Examiner*—Trinh Vo Dinh
(74) *Attorney, Agent, or Firm*—Robert A. Diehl

(57) ABSTRACT

An impedance plane has an elongated strip ship. The impedance plane approximates a magnetic conductor within a particular frequency band. A sector antenna is coupled to one side of the impedance plane. The sector antenna has a planar form factor with dimensions contained within the elongated strip. The sector antenna has a radiation pattern in the particular frequency band that is flared out from the impedance plane at a particular angle.

21 Claims, 9 Drawing Sheets

OTHER PUBLICATIONS

"Artificial Magnetic Conductor (AMC) Technology Information Bulletin", Etenna, IS001-A May 23, 2003, pp. 1-2.
S. Rogers et al., "Artificial Magnetic Conductor (AMC) Technology Enables the Coexistence of 802.11b and Bluetooth(TM)", Etenna, Revision 8 Feb. 14, 2003, pp. 1-6.
Sanchez et al.; "Broadband Antennas Over Electronically Reconfigurable Artificial Magnetic Conductor Surfaces", Presented at the 2001 Antenna Applications Symposium, Monticello, IL, Sep. 19-21, 2001, pp. 1-14.
PCT Search Report dated Apr. 27, 2005.

* cited by examiner

LOW PROFILE SECTOR ANTENNA CONFIGURATION

FIELD OF THE INVENTION

The present invention relates to the field of wireless communications. More specifically, the present invention relates to a low profile, sector antenna configuration.

BACKGROUND

Wireless communications are a driving force in the electronics industry. Wireless connections are widely used for computer networking, peripheral devices, and the like. Antennas are an integral part of all wireless communications. The amount of data that a wireless connection can carry, as well as the distance and the coverage of a wireless connection, often depend in large part on the size, type, and configuration of the antenna(s) being used. Larger antennas tend to provide better connectivity, but large antennas can be inconvenient, fragile, and unsightly. Furthermore, the form factors of many electronic devices do not readily accommodate large or fragile antennas.

Notebook computers provide a good example of the design challenges for antennas. Wireless networking is increasingly popular among notebook computer users. Notebook computers, however, are often compact, leaving limited room for an antenna. Durability is also quite important because notebook computers are frequently moved, packed away and pulled out of bags or carrying cases, used in cramped quarters, and the like. External housings are often made of metal to improve durability, but metal can interfere with, or shield, an antenna. This shielding effect makes an internal antenna especially difficult to implement. Attaching an antenna flush against a metal surface can also be problematic. A protruding antenna, on the other hand, can be vulnerable to damage, not to mention unsightly.

BRIEF DESCRIPTION OF DRAWINGS

Examples of the present invention are illustrated in the accompanying drawings. The accompanying drawings, however, do not limit the scope of the present invention. Similar references in the drawings indicate similar elements.

DETAILED DESCRIPTION OF THE INVENTION

In the following detailed description, numerous specific details are set forth in order to provide a thorough understanding of the present invention. However, those skilled in the art will understand that the present invention may be practiced without these specific details, that the present invention is not limited to the depicted embodiments, and that the present invention may be practiced in a variety of alternative embodiments. In other instances, well known methods, procedures, components, and circuits have not been described in detail. Parts of the description will be presented using terminology commonly employed by those skilled in the art to convey the substance of their work to others skilled in the art. Repeated usage of the phrase "in one embodiment" does not necessarily refer to the same embodiment, although it may.

Embodiments of the present invention combine a strip of magnetic conductor material and a sector antenna into a low profile, sector antenna configuration that can, for example, be mounted flush on a metal surface. Various embodiments of the present invention also arrange a combination of these low profile, sector antennas in different orientations to provide improved, sectorized connectivity.

A sector antenna is directional. In other words, the radiation pattern of a sector antenna is designed to transmit and/or receive a signal in a particular direction, or orientation, with respect to the antenna. Compared to an omni-directional antenna, or a multi-directional antenna, a sector antenna can provide superior connectivity for signals within its radiation pattern.

Figure 1:
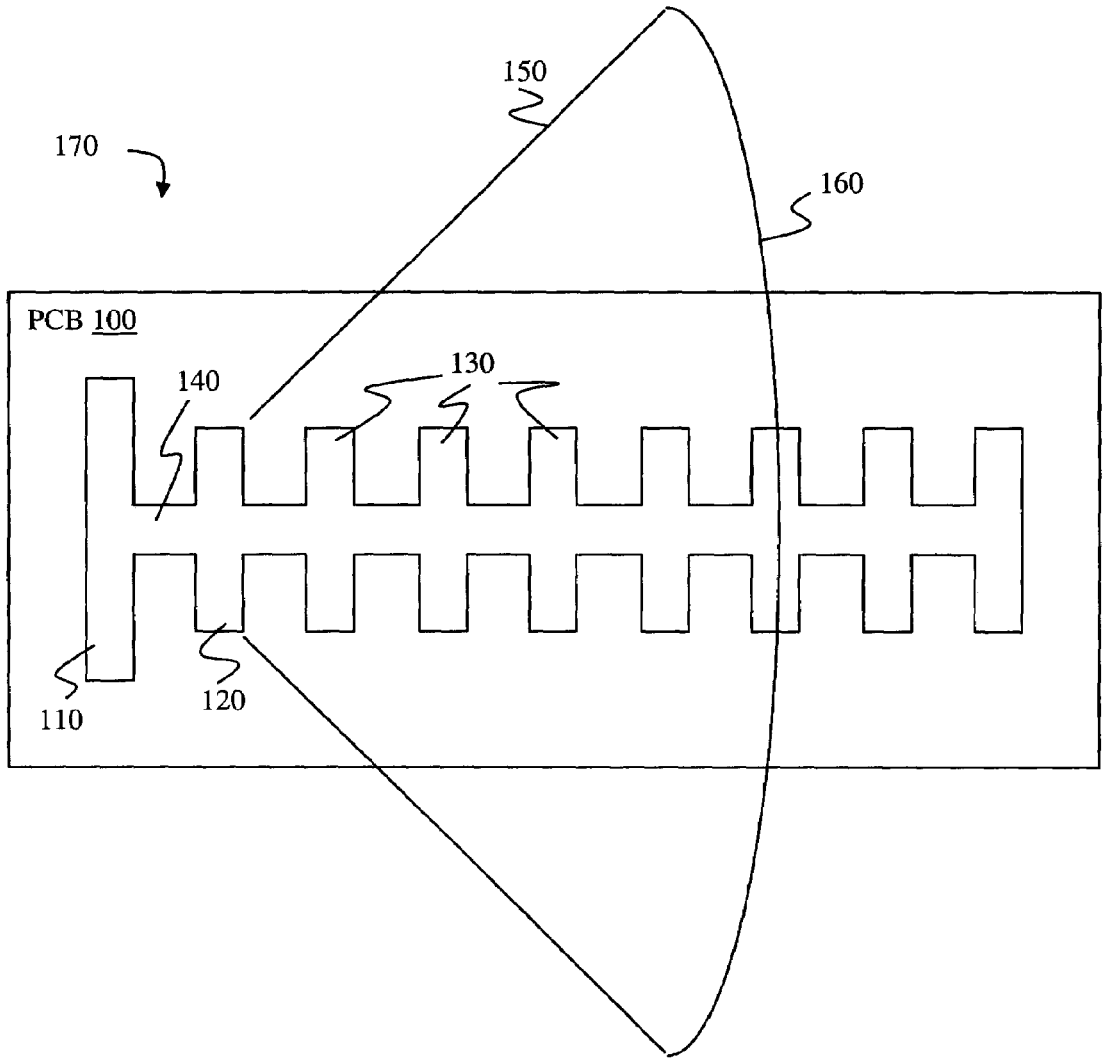
FIGS. 1 and 2 illustrate one embodiment of a sector antenna.

A Yagi antenna is one example of a sector antenna. FIG. 1 illustrates one embodiment of a Yagi antenna 170. A number of parallel dipoles 110,120, and 130 are arranged perpendicularly along a common axis 140. Dipole 120 is often called the driven dipole, where a signal enters or leaves the antenna. Dipole 110 is usually longer than dipole 120 and is often called the reflector dipole. Dipoles 130 are often called director dipoles. A Yagi antenna may include one or more director dipoles.

The antenna's radiation pattern 150 is generally directed along the common axis 140, and fans out at a particular angle 160. The angle 160 is often called an azimuth or elevation, depending on how the antenna is oriented. Azimuth usually refers to the angle in a horizontal plane and elevation usually refers to the angle in a vertical plane. The azimuth and elevation angles can be different for a given antenna. In the illustrated embodiment, angle 160 is over 90 degrees.

A Yagi antenna can be made in a planar form factor with a low profile. For instance, as shown in FIG. 1, the antenna 170 can be printed in a layer of a printed circuit board (PCB) 100. Additional layers of the PCB above and below the antenna can provide a great deal of protection for the antenna in a form factor that is mere millimeters or less in thickness.

Figure 2:
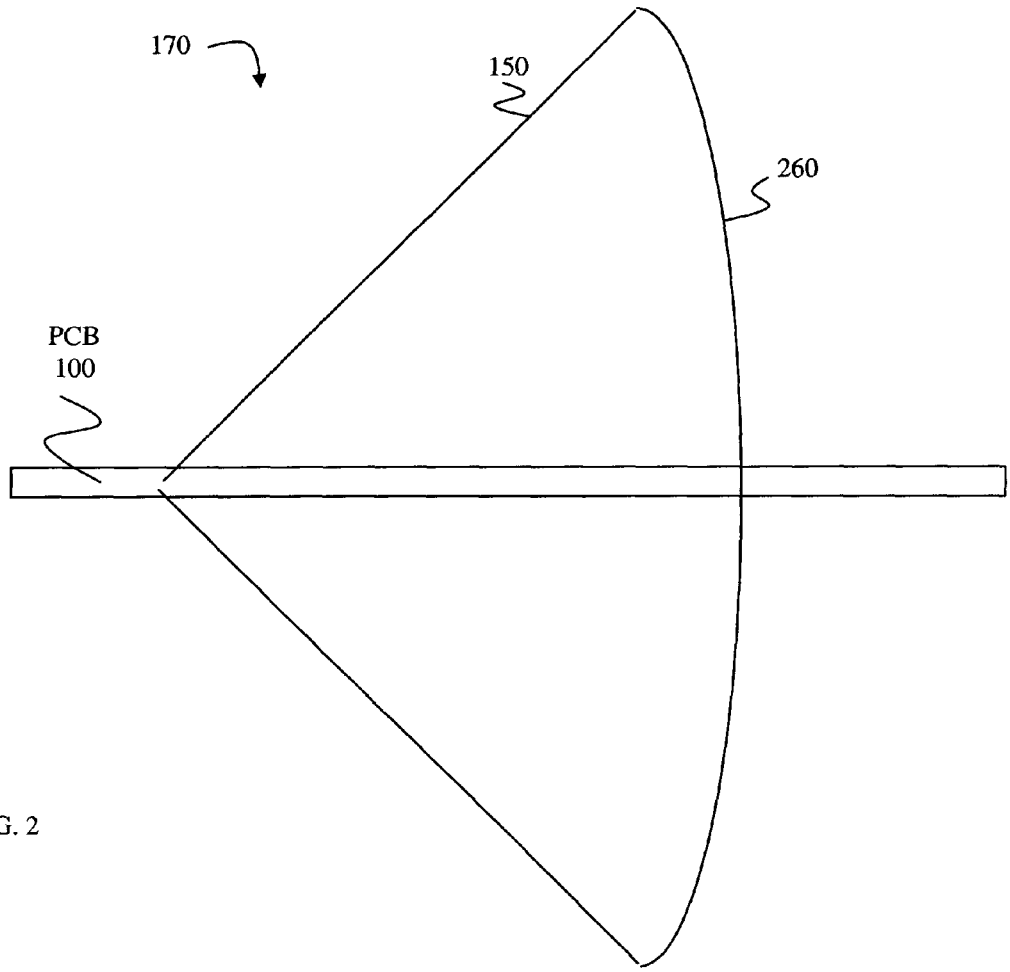

FIG. 2 illustrates a side view of the Yagi antenna 170 from FIG. 1. The radiation pattern 150 can also be seen in this view as it is generally directed along the length of the antenna. The angle 260 at which the radiation pattern fans out may be different in this orientation than angle 160 in FIG. 1.

The magnetic conductor material used in various embodiments of the present invention is an impedance plane that acts as a sort of radio frequency mirror, both altering the direction of the radiation pattern of the sector antenna and providing improved isolation for the antenna. Artificial Magnetic Conductor (AMC) material is a type of magnetic conductor. AMC is usually made from layers of printed circuit board (PCB) material comprising metal patches, vias (holes), and dielectric material, giving it a planar form factor. In some embodiments, the AMC material can have a thickness of 4 millimeters or less.

AMC is designed to approximate a perfect magnetic conductor for signals in at least one particular frequency band. For example, single-band AMC material can approximate a perfect magnetic conductor in one frequency band, and dual-band AMC material can approximate a perfect magnetic conductor in two frequency bands.

Figure 3:
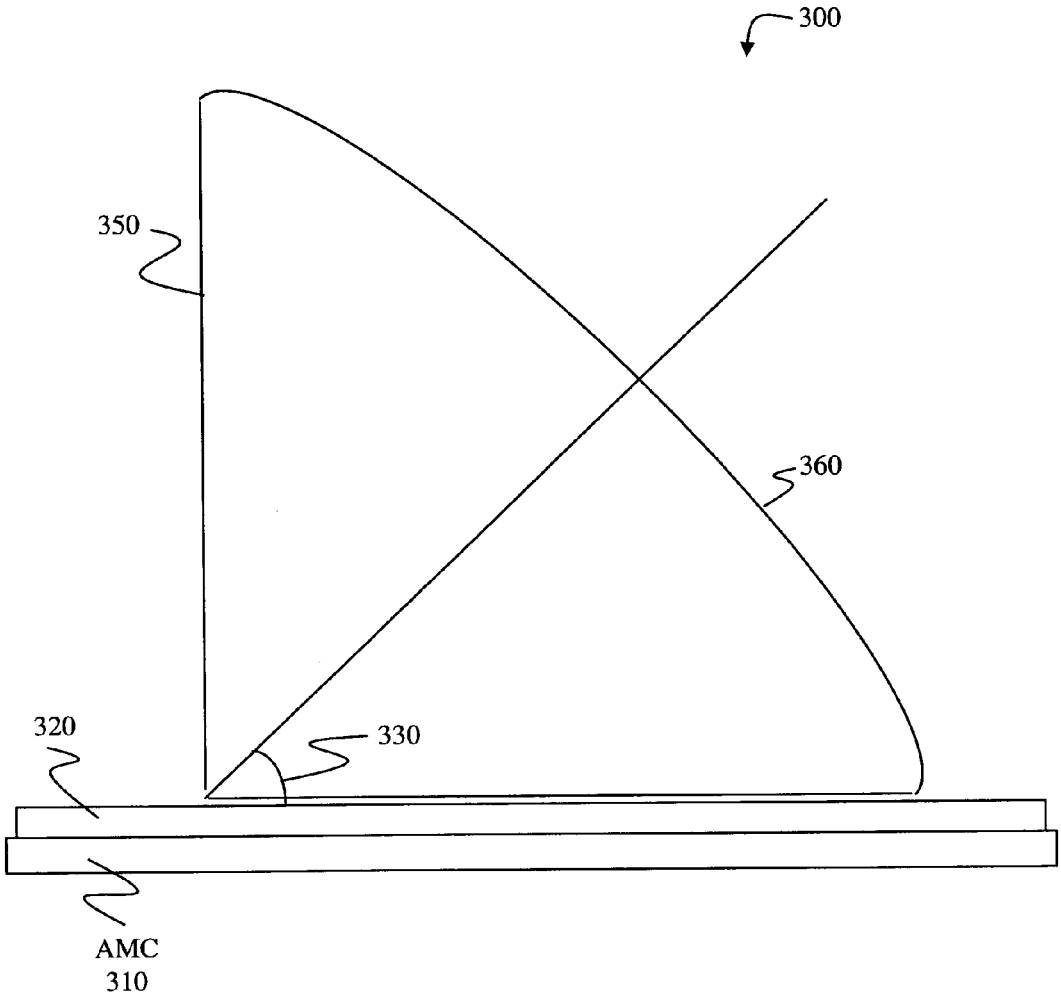
FIGS. 3 and 4 illustrate one embodiment of a sector antenna configuration.
Figure 4:
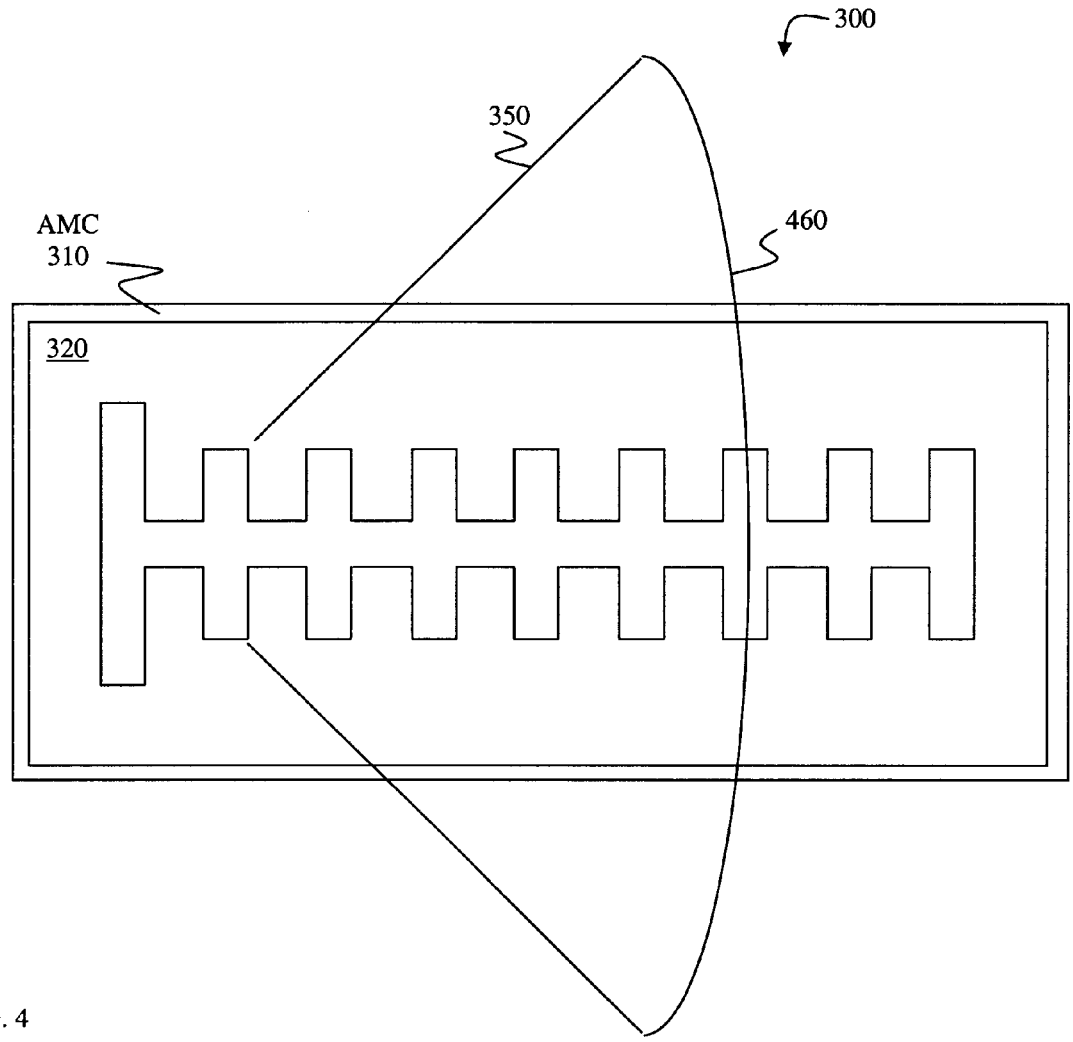

FIGS. 3 and 4 illustrate one embodiment of a low profile, sector antenna configuration 300. Sector antenna 320 and AMC strip 310 both have planar form factors. Sector antenna 320 is mounted flush against AMC 310 so that the dimensions of sector antenna 320 fit within the elongated strip of AMC 310.

AMC 310 alters the radiation pattern that sector antenna 320 would otherwise have. For signals in the appropriate frequency band(s) where AMC 310 approximates a perfect magnetic conductor, antenna configuration 300 has a radiation pattern 350 that is flared up at an angle 330. One or both of the fan-out angles 360 and 460 (shown in FIG. 4), however, may be largely unaffected by AMC 310.

For example, if Yagi antenna 170 from FIGS. 1 and 2 were used for sector antenna 320, the shape of the radiation pattern 350 would be substantially similar to the shape of radiation pattern 150, just redirected from the plane of the PCB by the angle 330. In other words, the fan-out angle 360, like angle 260, would be over 90 degrees.

In the illustrated embodiment, angle 330 is about 45 degrees. However, in alternate embodiments, a variety of angles may be achieved by various combinations of sector antennas and magnetic conductor materials. For example, the angle 330 may be from 35 degrees to 60 degrees in certain embodiments. In the case of a dual-band AMC strip, the radiation patterns, and the extent to which they are affected by the AMC material, may also be different for each band.

Figure 5:
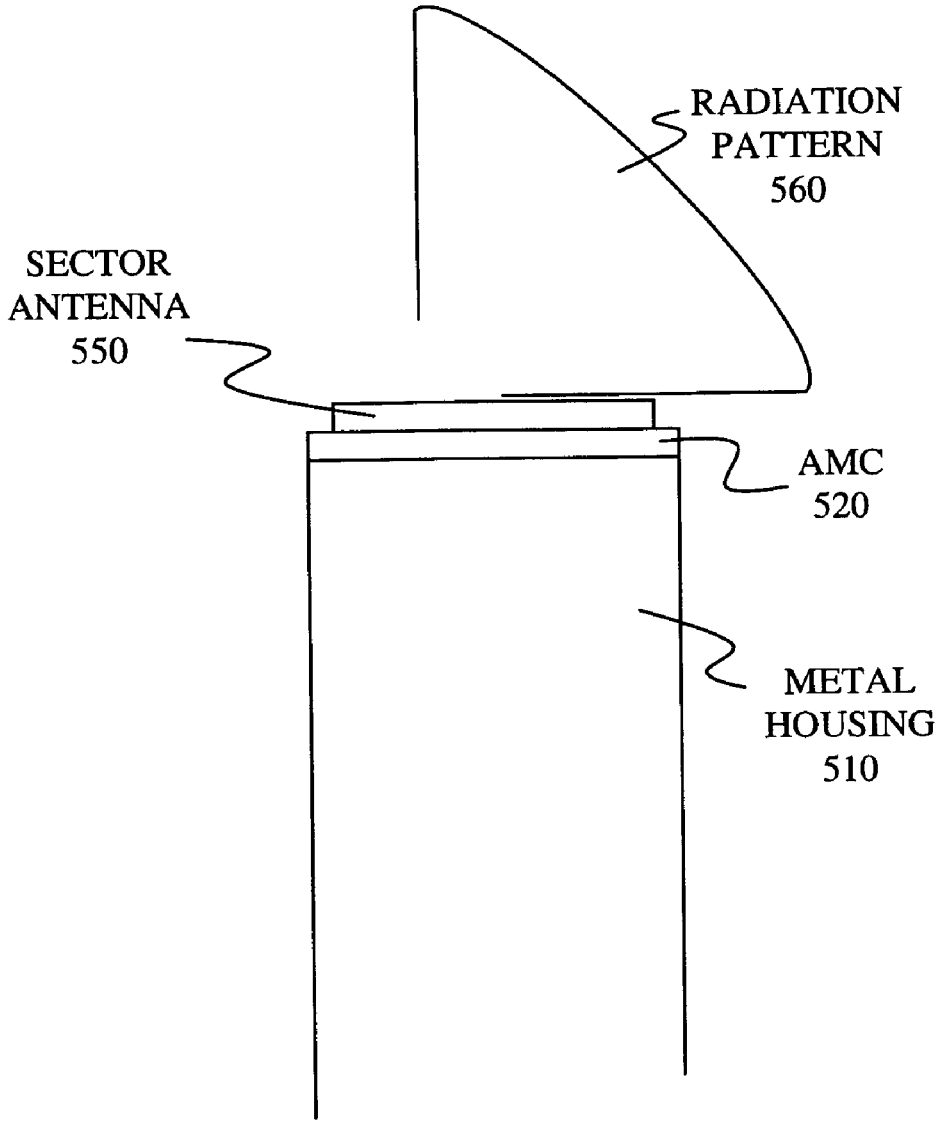
FIG. 5 illustrates one embodiment of a sector antenna configuration mounted on a metal housing.

FIG. 5 illustrates one embodiment of the present invention in which the sector antenna configuration is mounted flush to a metal housing 510. That is, AMC 520 is coupled flush to housing 510, and sector antenna 550 is coupled flush to AMC 520. AMC 520 limits or suppresses surface currents for signals in the appropriate frequency band(s). In other words, AMC 520 improves isolation between antenna 550 and metal housing 510, limiting or eliminating any effects of metal housing 510 on the shape and direction of radiation pattern 560.

Figure 6:
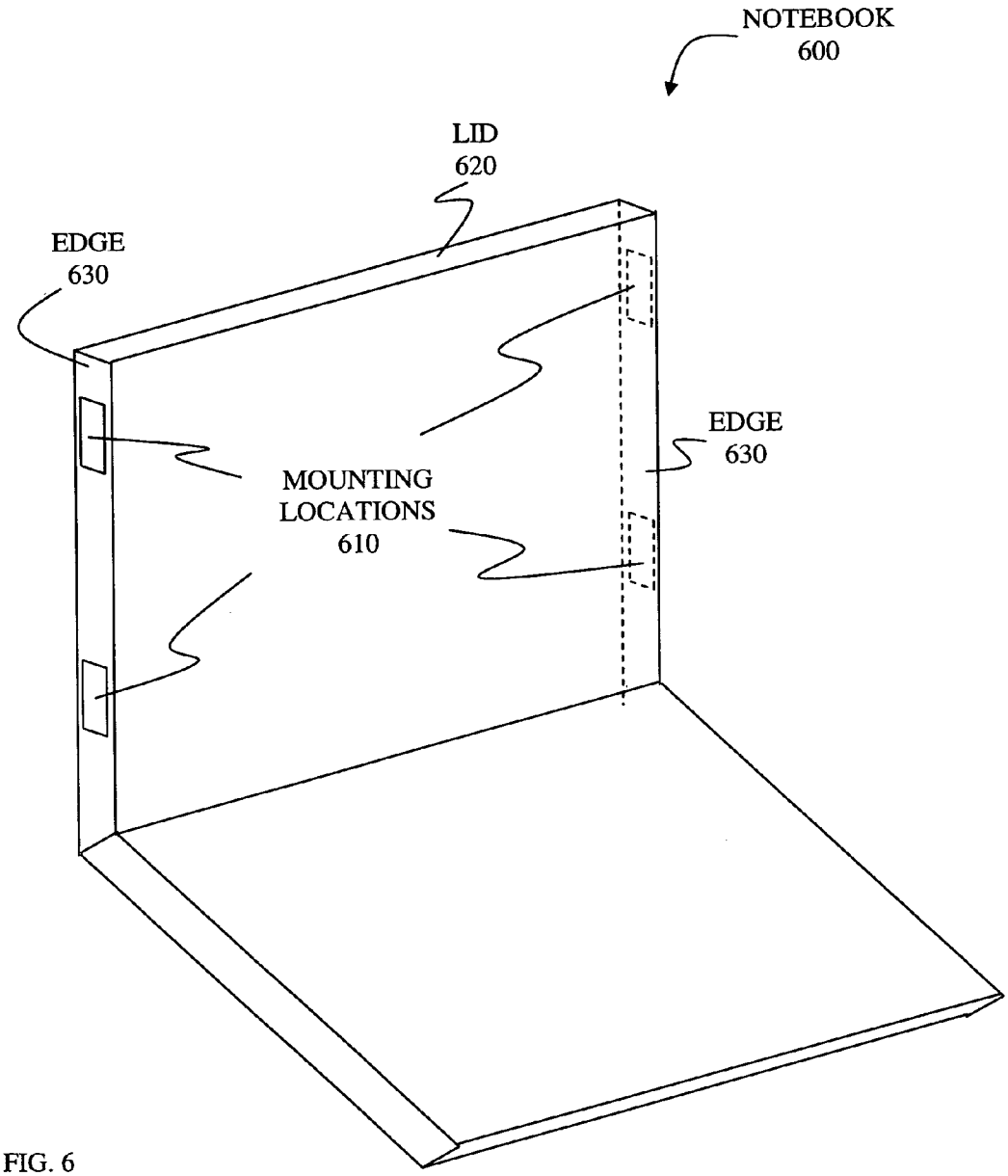
FIG. 6 illustrates one embodiment of mounting locations on a notebook computer.
Figure 7:
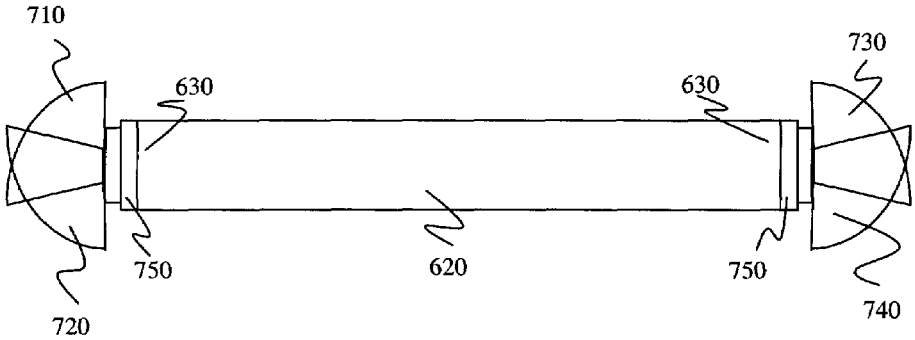
FIG. 7 illustrates one embodiment of radiation patterns from an array of sector antenna configurations.
Figure 8:
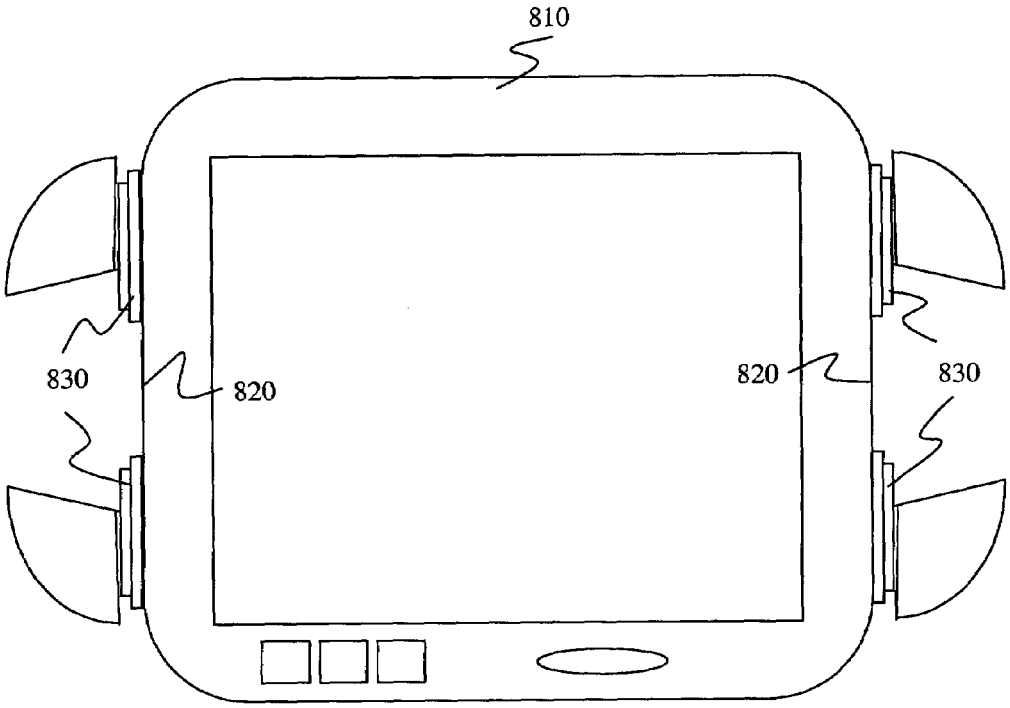
FIG. 8 illustrates one embodiment of an array of sector antenna configurations mounted on a tablet computer.

The inventive sector antenna configuration can be used in a variety of embodiments. For example, FIGS. 6–8 illustrate embodiments that use multiple antennas to provide sectorized antenna coverage. Since sector antennas tend to perform better compared to omni-directional antennas, at least in one direction, using an array of multiple sector antennas to provide omni-directional coverage can provide superior connectivity.

FIG. 6 illustrates one embodiment of a notebook computer 600 that has four mounting locations 610 on opposite edges 630 of its lid 620. Thanks to the magnetic conductor material, a sector antenna configuration can be flushly mounted at each mounting location 610, even if notebook 600 has a metal housing. By orienting the radiation patterns of a pair of sector antennas on each edge 630 in opposite directions, the pair of sector antennas can provide signal coverage for 180 degrees or more of azimuth. A pair of similarly oriented sector antennas on the opposite edge 630 can provide another 180 degrees of coverage. All together, the four sector antennas can provide 360 degrees of azimuth around the notebook.

The sector antennas can be oriented in any number of ways. For instance, an antenna mounted at a top mounting location on one edge of the notebook may be aligned so that the long axis of the antenna is parallel, or substantially parallel, to the long dimension of the edge of the notebook, with the radiation pattern angled up. The lower antenna on the same edge may also be mounted in a parallel configuration, but with the radiation pattern angled down. The antennas on the opposite side may use the same orientation. In another embodiment, the antennas may be aligned in a perpendicular, or substantially perpendicular, orientation to the long dimension of the edge of the notebook. In which case, the radiation patterns for the top sector antennas may angle toward the front, or screen, side of the lid, and the lower radiation patterns may angle to the rear side of the lid. Alternate embodiments may use any number of combinations of parallel and perpendicular orientations, with radiation patterns pointing up, down, frontward, or backward. While many sector antenna arrays can provide 360 degrees of azimuth, some embodiments may provide less than 360 degrees of azimuth. And, while edge mounting locations are often convenient to provide 360 degrees of coverage, the sector antenna configurations of the present invention can be used in any number of mounting locations.

Figure 9:
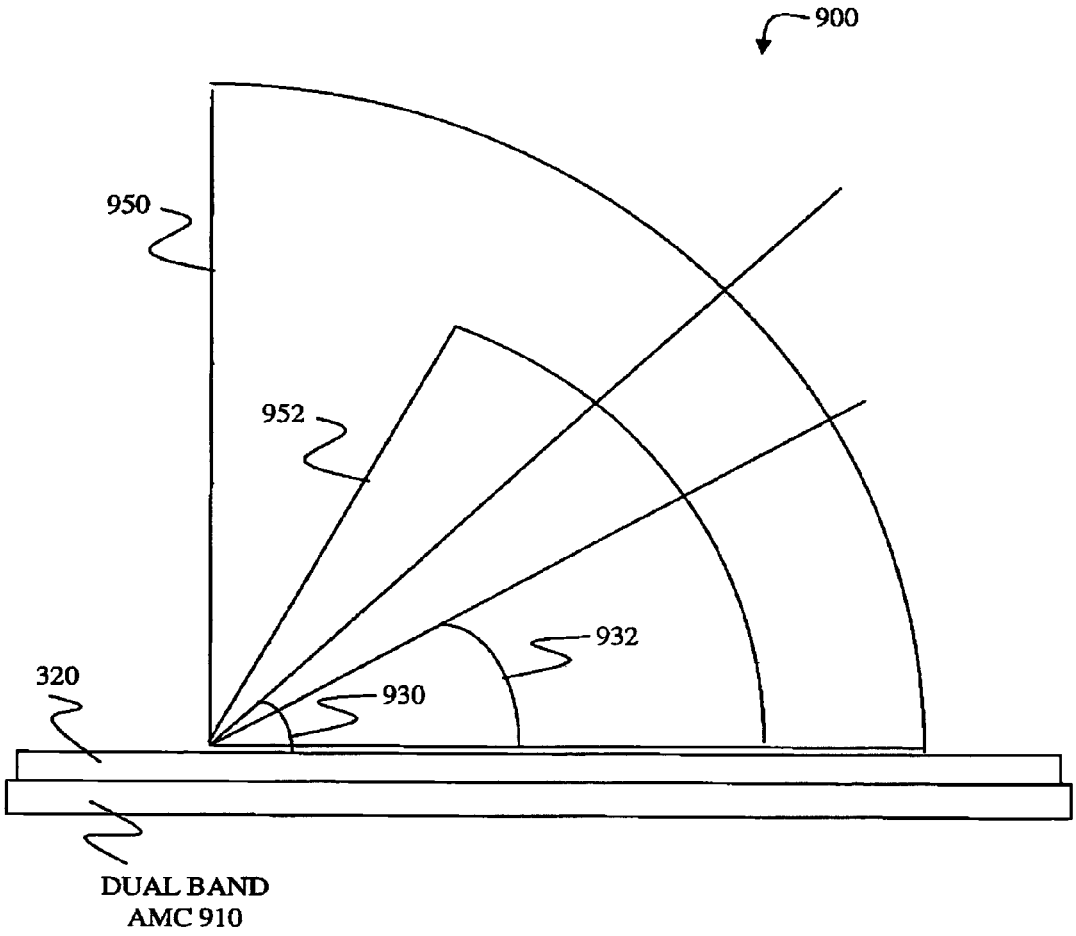
FIG. 9 illustrates one embodiment of a dual-band sector antenna configuration.

For example, FIG. 9 illustrates one embodiment of a dual-bands sector antenna configuration 900. Much like antenna configuration 300 shown in FIGS. 3 and 4, sector antenna 320 can be mounted flush against dual-band AMC material 910. Dual-band AMC strip 910 can approximate a perfect magnetic conductor for signals in two frequency bands, and differently alter the radiation pattern that sector antenna 320. Would otherwise have in each band. In the illustrated embodiment, radiation pattern 950 may correspond to one frequency band that is flared up at an angle 930, and radiation pattern 952 may correspond to another frequency band that is flared up at an angle 932.

FIG. 7 shows lid 620 from a top view with an array of four, perpendicularly mounted sector antennas 750. In this top view, only one antenna 750 can be seen on each edge 630, but there are actually two antennas 750 on each edge 630. The four antennas 750 provide four radiation patterns 710, 720, 730, and 740. In other words, two out of the four antennas 750 are oriented to radiate down in the figure (patterns 720 and 740), and two are oriented to radiate up in the figure (patterns 710 and 730). Together, the patterns provide 360 degrees of azimuth around lid 620.

FIG. 8 illustrates another sector antenna array on a tablet computer 810. Tablet 810 has a pair of sector antennas 830 mounted flush along each opposite edge 820. Each pair of sector antennas is mounted with opposite orientations to provide 180 degrees of coverage.

Thus, a low profile, sector antenna is described. Whereas many alterations and modifications of the present invention will be comprehended by a person skilled in the art after having read the foregoing description, it is to be understood that the particular embodiments shown and described by way of illustration are in no way intended to be considered limiting. Therefore, references to details of particular embodiments are not intended to limit the scope of the claims.

What is claimed is:

1. An apparatus comprising:

an impedance plane defining an elongated strip, said impedance plane comprising a magnetic conductor within at least a particular frequency band; and a sector antenna coupled to one side of the impedance plane, said sector antenna having a planar form factor with dimensions contained within the elongated strip, and said sector antenna having a radiation pattern in the particular frequency band that is flared out from the impedance plane at a particular angle, wherein the particular frequency band comprises a first frequency band, said impedance plane further comprising a magnetic conductor within a second frequency band, said sector antenna having radiation patterns that flare out from the impedance plane in both the first and second frequency bands.

2. The apparatus of claim 1 further comprising:

a conductor plane coupled to the impedance plane on a side opposite the sector antenna, said impedance plane to suppress surface currents between the sector antenna and the conductor plane.

3. The apparatus of claim 1 wherein the conductor plane comprises a metal housing.

4. The apparatus of claim 3 wherein the metal housing comprises a housing for one of a notebook computer and a tablet computer.

5. The apparatus of claim 1 wherein the sector antenna comprises a plurality of short elements arranged in parallel to one another, and perpendicular to a common axis, said common axis being parallel to a long dimension of the impedance plane.

6. The apparatus of claim 1 wherein the sector antenna comprises a Yagi-type antenna.

7. The apparatus of claim 1 wherein the impedance plane comprises an Artificial Magnetic Conductor (AMC).

8. The apparatus of claim 1 wherein the particular angle is between 35 and 60 degrees.

9. An apparatus comprising:

an impedance plane defining an elongated strip, said impedance plane comprising a magnetic conductor within at least a particular frequency band;

a sector antenna coupled to one side of the impedance plane, said sector antenna having a planar form factor with dimensions contained within the elongated strip, and said sector antenna having a radiation pattern in the particular frequency band that is flared out from the impedance plane at a particular angle;

a conductor plane coupled to the impedance plane on a side opposite the sector antenna, said impedance plane to suppress surface currents between the sector antenna and the conductor plane;

a plurality of additional impedance planes, each of the plurality of additional impedance planes defining an elongated strip, and comprising a magnetic conductor within at least a particular frequency band; and a plurality of additional sector antennas each coupled to one side of a respective one of the plurality of additional impedance planes, each of the plurality of additional sector antennas having a planar form factor with dimensions contained within the respective elongated strip, having a radiation pattern in the respective particular frequency band that is flared out from the respective impedance plane at a particular angle.

10. The apparatus of claim 9 wherein the impedance plane and the plurality of additional impedance planes together comprise four impedance planes.

11. The apparatus of claim 10 wherein the impedance planes are coupled in pairs to opposites sides of a host device, and the radiation patterns from each pair are arranged in opposite orientations.

12. A system comprising:

a computer; and a plurality of sector antenna units coupled to the computer, each of the sector antenna units comprising an impedance plane defining an elongated strip, said impedance plane comprising a magnetic conductor within at least a particular frequency band, and a sector antenna coupled to one side of the impedance plane, said sector antenna having a planar form factor with dimensions contained within the elongated strip, and said sector antenna having a radiation pattern in the particular frequency band that is flared out from the impedance plane at a particular angle.

13. The system of claim 12 wherein the computer comprises one of a notebook computer and a tablet computer.

14. The system of claim 12 wherein the computer comprises a metal housing coupled to the plurality of sector antenna units on a side of each respective impedance plane opposite the respective sector antennas.

15. The system of claim 12 further comprising a plurality of mounting locations on the computer corresponding to the plurality of sector antenna units.

16. The system of claim 15 wherein the plurality of mounting locations comprise two locations on each of two opposite edges of the computer.

17. The system of claim 16 wherein the two opposite edges comprise opposite edges of a lid of the computer.

18. The system of claim 17 wherein, on each of the opposite edges of the lid, two of the sector antenna units are coupled with their respective radiation patterns arranged in opposite orientations.

19. The system of claim 12 wherein each of the impedance planes comprises an Artificial Magnetic Conductor (AMC).

20. The system of claim 12 wherein each of the sector antennas comprises a Yagi-type antenna.

21. The system of claim 12 wherein at least one of the radiation patterns comprises an azimuth of greater than or equal to 90 degrees.

* * * * *